US007668326B2

(12) United States Patent
Linkenkær-Hansen

(10) Patent No.: US 7,668,326 B2
(45) Date of Patent: Feb. 23, 2010

(54) BATTERY COMPARTMENT FOR A HEARING AID

(75) Inventor: Morten Linkenkær-Hansen, Vaerloese (DK)

(73) Assignee: WIDEX A/S, Vaerloese (DK)

( * ) Notice: Subject to any disclaimer, the term of this patent is extended or adjusted under 35 U.S.C. 154(b) by 972 days.

(21) Appl. No.: 11/202,089

(22) Filed: Aug. 12, 2005

(65) Prior Publication Data

US 2005/0286732 A1 Dec. 29, 2005

Related U.S. Application Data

(63) Continuation-in-part of application No. PCT/DK03/00099, filed on Feb. 14, 2003.

(51) Int. Cl.
*H04R 25/00* (2006.01)

(52) U.S. Cl. ..... 381/322; 381/323

(58) Field of Classification Search ..... 381/312, 381/314, 322, 323, 324, 330, 328; 429/96, 429/97, 100

See application file for complete search history.

(56) References Cited

U.S. PATENT DOCUMENTS

| | | | | |
|---|---|---|---|---|
| 3,475,566 | A | 10/1969 | Bauer | |
| 4,598,177 | A | 7/1986 | McGroarty | |
| 4,941,180 | A * | 7/1990 | Buettner | 381/323 |
| 4,947,439 | A | 8/1990 | Buettner | |
| 5,062,138 | A | 10/1991 | Schmid | |
| 5,588,064 | A * | 12/1996 | McSwiggen et al. | 381/312 |
| 5,687,242 | A * | 11/1997 | Iburg | 381/312 |
| 6,041,128 | A | 3/2000 | Narisawa | |
| 6,324,291 | B1 | 11/2001 | Weidner | |

FOREIGN PATENT DOCUMENTS

| | | |
|---|---|---|
| DE | G 93 07 905.2 U1 | 10/1994 |
| JP | 56056099 | 5/1981 |
| JP | 6339864 U | 3/1988 |
| JP | 09215098 | 8/1997 |
| JP | 11016552 | 1/1999 |
| WO | WO 00/21335 | 4/2000 |
| WO | WO 00/78934 A2 | 12/2000 |

* cited by examiner

*Primary Examiner*—Huyen D Le
(74) *Attorney, Agent, or Firm*—Sughrue Mion, PLLC

(57) ABSTRACT

A battery compartment for a hearing aid. The battery compartment comprises a first portion for accommodating a battery and a second portion, where the second portion comprises at least one retaining element for securing the position of the battery compartment with respect to a housing of said hearing aid. The first and second portions of the battery compartment are provided as first and second separate parts (1, 2) comprising releasable interlocking means (12, 14) for mutual engagement.

20 Claims, 7 Drawing Sheets

BATTERY COMPARTMENT FOR A HEARING AID

RELATED APPLICATIONS

The present application is a continuation-in-part of application No. PCT/DK2003/00099, filed on Feb. 14, 2003, in Denmark and published as WO 2004/073351 A1.

BACKGROUND OF THE INVENTION

1. Field of the Invention

The present invention relates to hearing aids. More specifically the invention relates to a removable battery compartment for a hearing aid. The invention also relates to a hearing aid comprising such a battery compartment.

2. The Prior Art

Battery compartments for hearing aids may be constructed in various ways. One common way is to construct the battery compartment as a drawer or a holder, in which the battery is placed, upon which the drawer is pushed from an open position into a closed position in the housing. In this way the housing serves to close the battery compartment. Such a drawer is illustrated in e.g. U.S. Pat. No. 3,475,566. Typically the holder has a pivot point about which the holder rotates while being pushed into the housing. Such holders are illustrated in e.g. WO-A-00/21335 and U.S. Pat. No. 5,588,064.

Moreover the pivoting motion, or at least a part of it, is in some designs used to slide the battery terminals over a set of contacts, thereby allowing the motion also to be used for switching the hearing aid on and off, or for performing other switching functions as in the above U.S. Pat. No. 5,588,064. Retaining means may be provided to hold the battery compartment in the closed position, and possibly in an intermediate position where the power supply to the hearing aid is interrupted but the battery is not accessible for removal.

For removal of the battery, the compartment is removed from, withdrawn from or pivoted out of the housing to a position where the battery is accessible for removal. This however involves a concern, because different people have different needs. For certain persons, such as small children, it is desirable to restrict the access to the battery compartment, as there is otherwise a risk that they could remove the battery and possibly swallow it. On the other hand, generally providing hearing aids, or the drawers of such, with a child-proof locking mechanism is not desirable, because a considerable number of hearing aid users are elderly people not always physically able to perform the delicate manipulations necessary to overcome the child-proof locking mechanism. There is thus a problem in providing a hearing aid that serves the above different needs of different people.

SUMMARY OF THE INVENTION

It is the object of the present invention to provide a hearing aid, which overcomes the above problem.

According to the invention, in a first aspect, this object is achieved by providing a battery compartment for a hearing aid, said battery compartment comprising a first portion for accommodating a battery and a second portion comprising a resilient arm having a retaining element, said arm including a latching element adapted for snapping into engagement with a housing of the hearing aid for selectively securing the position of said battery compartment with respect to the housing, said arm being movable according to a first motion between a first position wherein said latching element engages the housing, and a second position, wherein said first portion may be moved according to a second motion so as to open said battery compartment, said first and second portions of the battery compartment being provided as first and second separate parts, and said first and second parts comprising releasable interlocking means for mutual engagement.

The use of a latching element provides for child-proofing of the battery compartment, as it involves additional manipulation of the retaining element or the resilient arm in order to unlatch it before opening the battery compartment. Providing the battery compartment as two separate parts allows one part to be interchangeable, so as to optionally provide the battery compartment with a child-proof retaining element, which latches in such a manner that special manipulation is necessary, or a simple retaining element, which does not necessitate such manipulation.

According to a preferred embodiment, the interlocking means comprises at least one barb. This is a convenient way of providing a releasable interlocking means.

According to a further embodiment, the interlocking means comprises at least one barb located on the second part. Providing the barb on the interchangeable part is advantageous in the event that the barb or the arm on which it is located should break or in other way be damaged.

Preferably, the retaining element comprises a protrusion located on a resilient arm. The use of an arm allows good resilience and long travel in the release motion of the retaining element, while the retaining element can be used as a pivot point, about which the battery compartment pivots during the on/off switching motion.

In a preferred embodiment, the resilient arm is located on the second part. Locating the resilient arm on the interchangeable part is advantageous in the event that the arm should break or in other way be damaged during manipulation.

In a preferred embodiment, the latching element comprises a rib with a step provided on said protrusion. Providing a rib breaks the otherwise relatively smooth surface of the protrusion, in the sense that a step-like discontinuity is formed. The step prevents return motion of the retaining element, once the rib has snapped into engagement with the hearing aid housing.

Irrespective of whether the protrusion is provided with the latching means or not, the protrusion provides, in a further preferred embodiment, a pivot point for the battery compartment. Thus the rotary motion of the on/off switching facility may conveniently be centered about this pivot point, obviating the need for further protrusions of shaft otherwise necessary for the pivot point.

In a specially preferred embodiment, the battery compartment is movable along a plane with respect to the housing, and said retaining element is movable out of said plane. If the battery compartment pivots, the pivot axis plane is perpendicular to the plane, and if the compartment slides in a translatory motion the compartment slides in the plane. The unlatching motion out of the plane provides for a two-step motion, before the battery compartment may be swung out. This two-step motion is sufficiently complicated for children to provide child-proofing.

In one embodiment, said battery compartment further comprises means for permitting manually moving said retaining element out of said plane. This provides for the manipulation necessary in order to carry out the two-step motion.

In a particular embodiment of the invention, the battery compartment comprises a visible code marking for indicating for which ear the hearing aid is intended. This is advantageous when, as it is often the case, identical houses are used for hearing aids for left and right ear, respectively. Providing code marking on an interchangeable piece, allows for code markings only to be used when necessary, e.g. when differently fitted hearings aids are used in different ears. When e.g. only one hearing aid is used, or if discretion is desired, an unmarked, and thus less conspicuous, piece can be used.

The code marking may e.g. be a color code. In this case differently colored pieces e.g. red and blue may be used, thus making the left and right hearing aids easily distinguishable. For people, which do not have the need to distinguish, e.g. because they are only using one hearing aid, a less conspicuous color, such as the color of the remainder of the hearing aid, typically beige, could be used.

According to the invention, in a second aspect, the object is met by providing a hearing aid comprising a housing, and a battery compartment for accommodating a battery, said battery compartment having a first portion and a second portion, wherein said first and second portion are provided as first and second separate parts, said first and second parts having releasable interlocking means for mutual engagement, said second part comprising a resilient arm with a retaining element having a latching element adapted for snapping into engagement with said housing for selectively securing the position of said battery compartment with respect to said housing, said arm being movable according to a first motion between a first position wherein said latching element engages the housing, and a second position, wherein said battery compartment may be moved according to a second motion so as to open said battery compartment.

According to the invention, in a third aspect, the object is met by providing a battery compartment for a hearing aid, comprising a resilient arm with a retaining element including a latching element adapted for snapping into engagement with a housing of the hearing aid for selectively securing the position of said battery compartment with respect to the housing, said arm being movable according to a first motion between a first position wherein said latching element engages the housing, and a second position, wherein said battery compartment may be moved according to a second motion so as to open said battery compartment.

According to the invention, in a fourth aspect, the object is met by providing a hearing aid comprising a housing, a battery compartment for accommodating a battery, and a resilient arm connected with said battery compartment and provided with a latching element adapted for snapping into engagement with said housing for selectively securing the position of said battery compartment with respect to said housing, said arm being movable according to a first motion between a first position wherein said latching element engages the housing, and a second position, wherein said battery compartment may be moved according to a second motion so as to open said battery compartment. Further embodiments will appear from the following description of preferred embodiments of the invention.

BRIEF DESCRIPTION OF THE DRAWINGS

The invention will now be explained in greater detail with reference to the appended drawings illustrating preferred embodiments of the invention. In the drawings

DETAILED DESCRIPTION OF THE INVENTION

Figure 1:
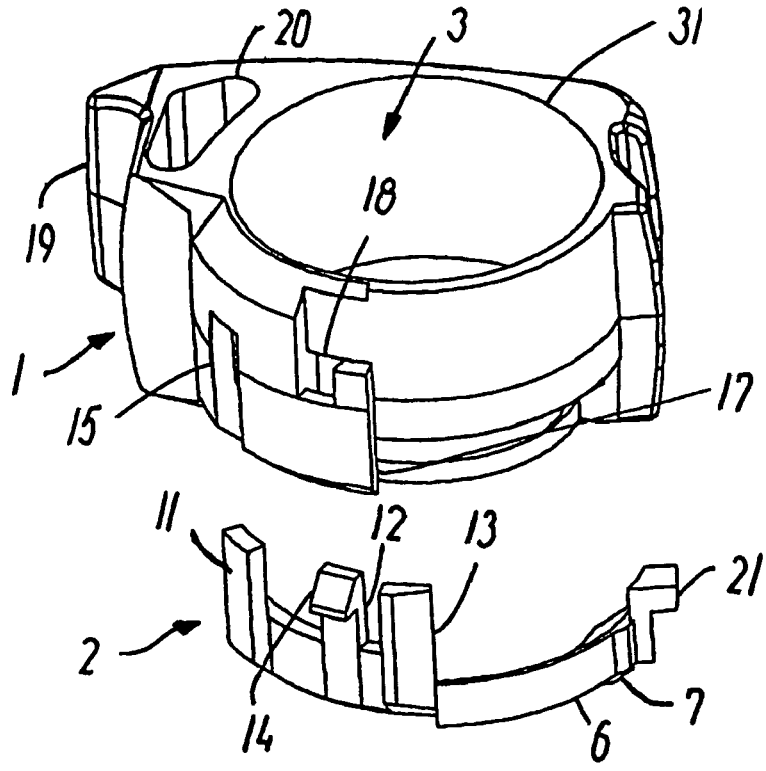
FIG. 1 shows a first exploded view of a battery compartment according to the invention, comprising first and second separate parts.

Reference is first made to FIG. 1, which shows an exploded view of a preferred embodiment of the battery compartment according to the invention. The battery compartment comprises two parts, a first part 1 and a second part 2.

Figure 3:
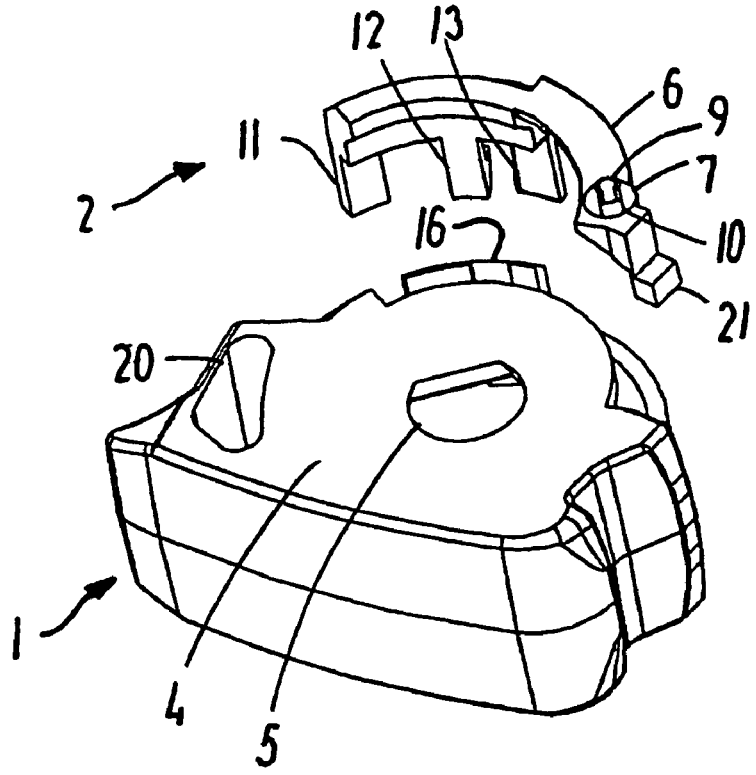
FIG. 3 shows a second exploded view of the battery compartment of FIG. 1.
Figure 4:
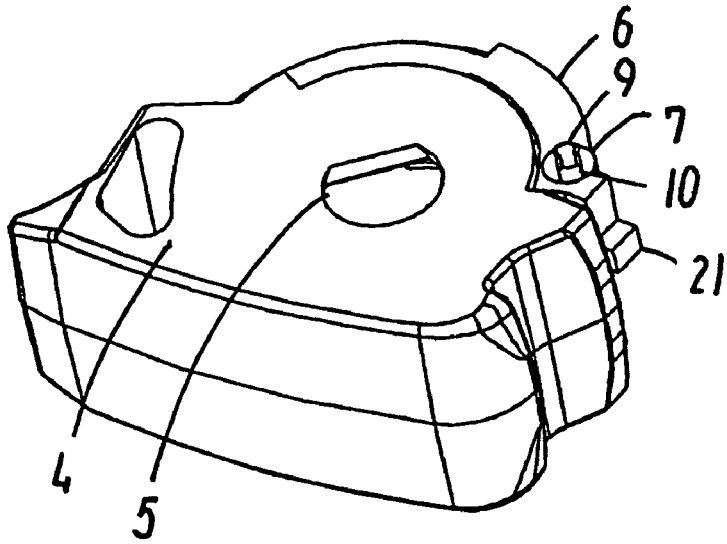
FIG. 4 shows a second perspective view of the battery compartment of FIG. 1 in the assembled state.
Figure 5:
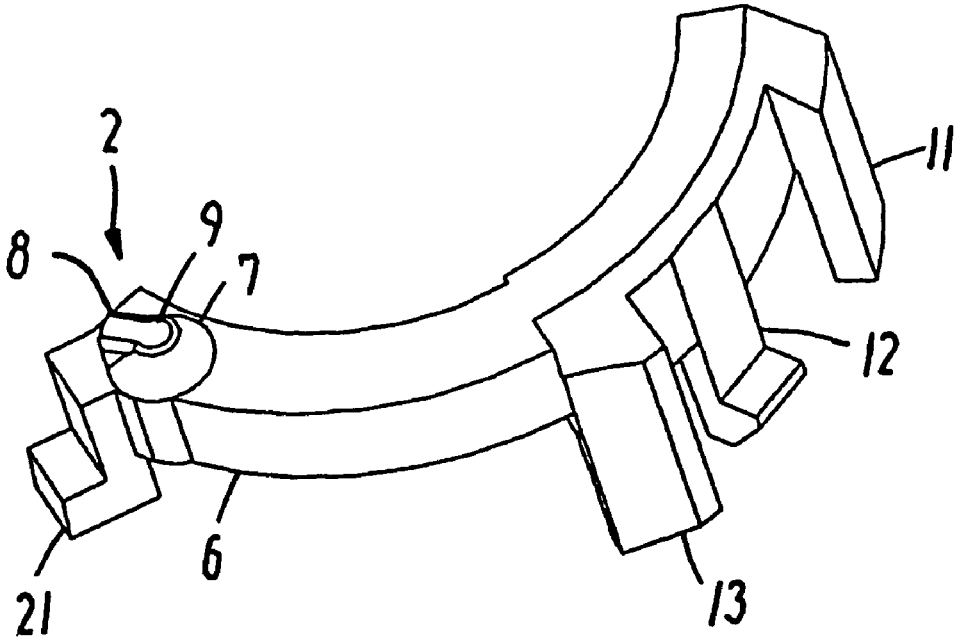
FIG. 5 shows a perspective view of a first embodiment of the second part of FIG. 1.
Figure 6:
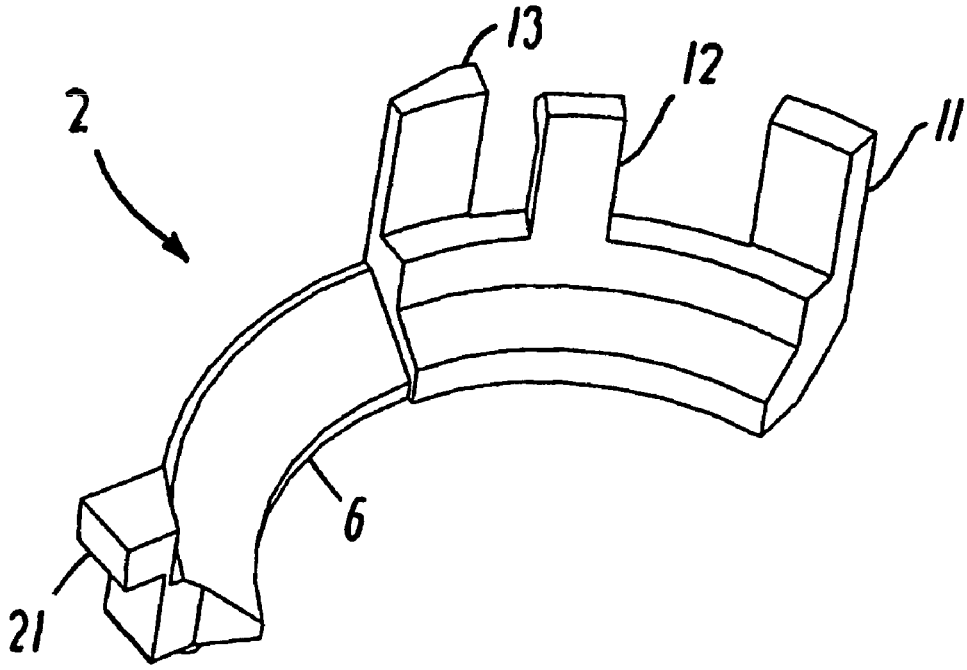
FIG. 6 shows a different perspective view of the second part illustrated in FIG. 5.

The first part 1 is the main part and comprises a recess 3, defined by a generally cylindrical wall 31 and by a bottom wall 4. The recess 3 is adapted for accommodating a battery (not shown). The first part 1 is preferably a one-piece molded part. In the bottom wall 4 of the recess 3 an aperture 5 (visible in FIGS. 3 and 4 only) is formed. The aperture 5 allows one terminal of the battery to make and break with a contact in the hearing aid housing 101 in a manner known per se, the other terminal of the battery making and breaking in a similar manner with another contact in the hearing aid housing through the uncovered upper end of the recess 3. The making and breaking of the battery with the contacts is effected by motion of the battery compartment, in a manner also known per se. Details of the contacts and the internal parts of the hearing aid housing 101 are not considered relevant for the present invention and have been omitted from the figures.

The second part 2 is an interchangeable part, which may be detachably mounted on said first part 1. Like the first part 1, the second part 2 is also preferably a one-piece molded part. The interchangeable second part 2 may come in various embodiments to serve different needs and functions as will be described below. The different embodiments of the second part are largely similar and corresponding parts will be indicated by the same reference numerals.

The second part 2 has a resilient arm 6. The resilient arm 6 extends essentially from the middle of the second part 2 so as to have one end, which is freely moveable. This freely moveable end carries a retaining element 7, in the form of a generally frusto-conical boss. At the other end of the second part 2 a number of perpendicular arms or uprights 11, 12, 13 for engaging the first part 1 are formed. The uprights 11, 12, 13 engage and secure the second part 2 in a fixed relationship with the first part 1 so as to allow only the resilient arm 6 to move with respect to the first part 1. For this purpose the first part has corresponding recesses 15, 16 and engagement surfaces 17. One recess 16 ends in an aperture 18 in which a barb 14 formed at the free end of one of the uprights 12 may latch. The upright 12 is sufficiently resilient to allow the barb 14 to be bent back during insertion of the second part 2 into the first part 1 with a sliding motion, along the recesses and surfaces. Upon insertion, the barb 14 reaches the aperture 18 and latches in it, thus securing the two parts in a fixed relationship. Though fixed, the relationship is not permanent. Thus, if it is desired to remove the second part 2, the barb 14 may be pressed back out of the aperture 18, so as to release the engagement, upon which the second part may be slid out of engagement with the first part 1. After removal of the second part 2 from the first part 1, it may be substituted with another, e.g. according to different embodiment, or, if it was broken or otherwise defective, with an intact one.

Figure 2:
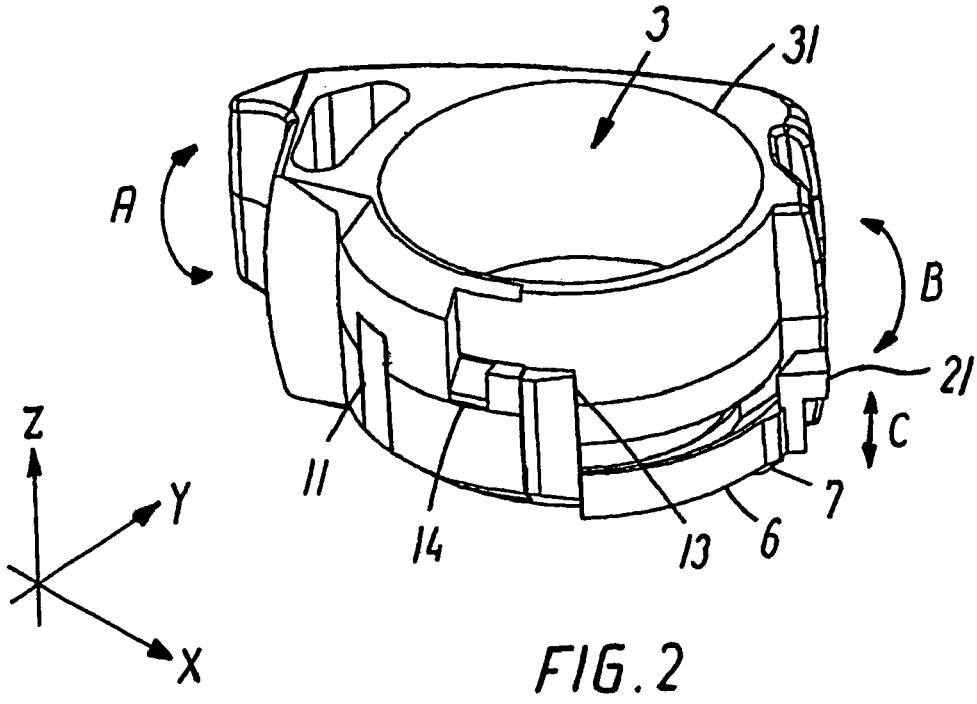
FIG. 2 shows a first perspective view of the battery compartment of FIG. 1 in the assembled state.
Figure 8:
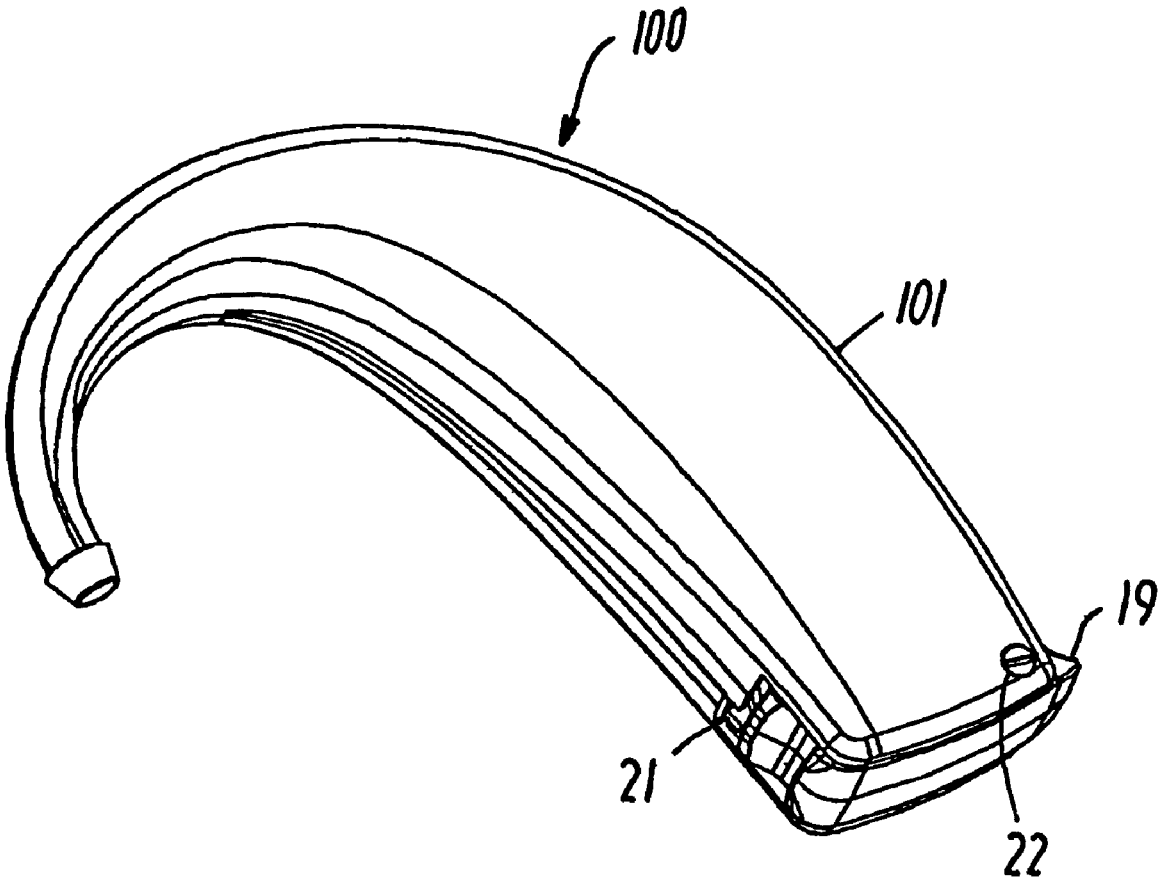
FIG. 8 shows a hearing aid with a battery compartment according to FIG. 1-7 in a first switching position.
Figure 9:
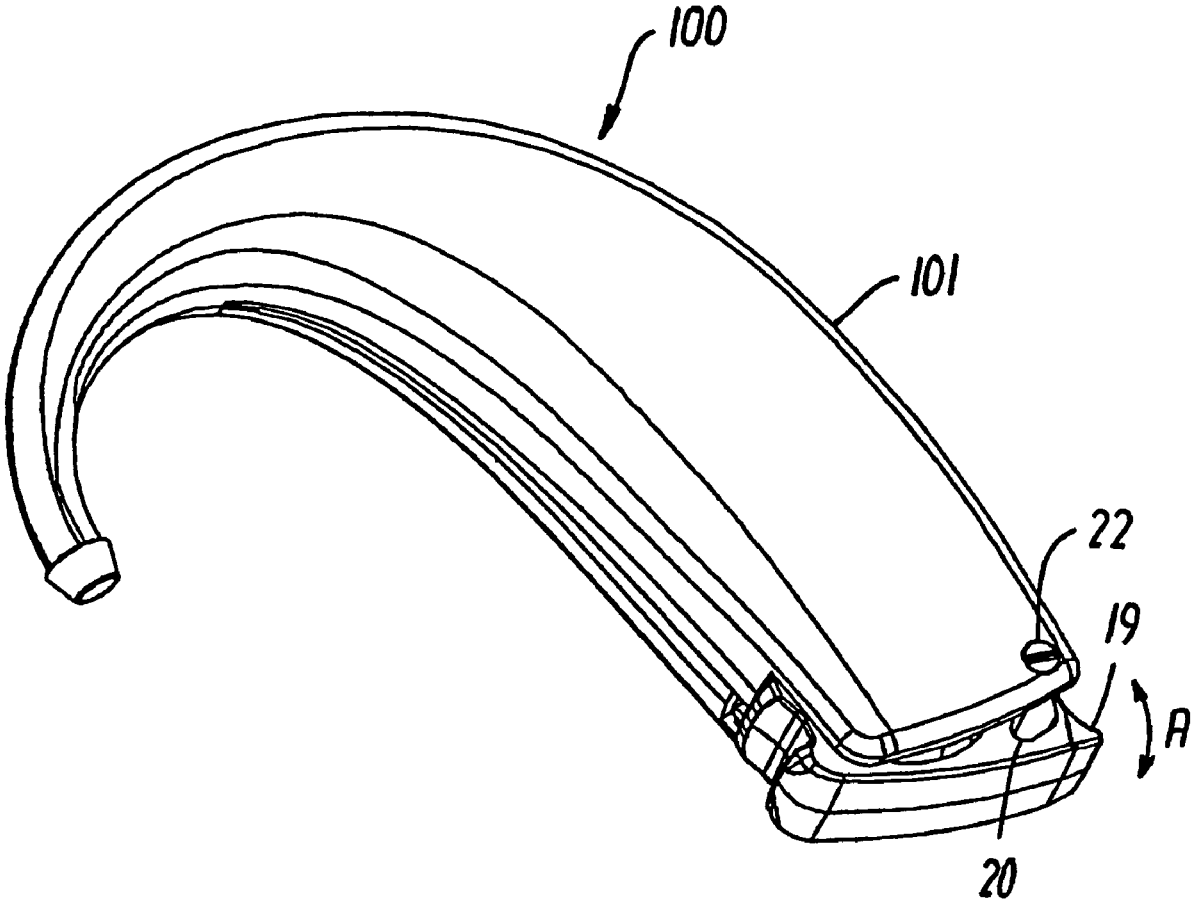
FIG. 9 shows the hearing aid of FIG. 8 with the battery compartment in a second switching position.

The essentially frusto-conical boss constituting the retaining element 7 serves dual functions. For one it serves to generally retain the battery compartment in the closed position, by engaging a corresponding recess (not shown) in the hearing aid housing 101. For the other, in this closed position the retaining element 7 serves as a pivot point for the pivotal motion in the X-Y plane, as illustrated by the double arrow A in FIGS. 2 and 9, effecting the switching on and off of the hearing aid 100. For this motion the first part 1 has an actuation protrusion 19 which may be manipulated by means of a finger of a hand. The on/off switching motion is limited by a curved long hole 20, in which a shaft, such as the shaft of a screw 22, or protrusions arranged in the hearing aid housing, engage. Thus the on/off switching can be effected through motion of the battery compartment through a restricted angle only, i.e. between the positions shown in FIGS. 8 and 9, respectively, about the pivot point constituted by the retaining element 7. Further motion will be blocked by the curved long hole 20 in conjunction with the shaft or protrusions.

Figure 10:
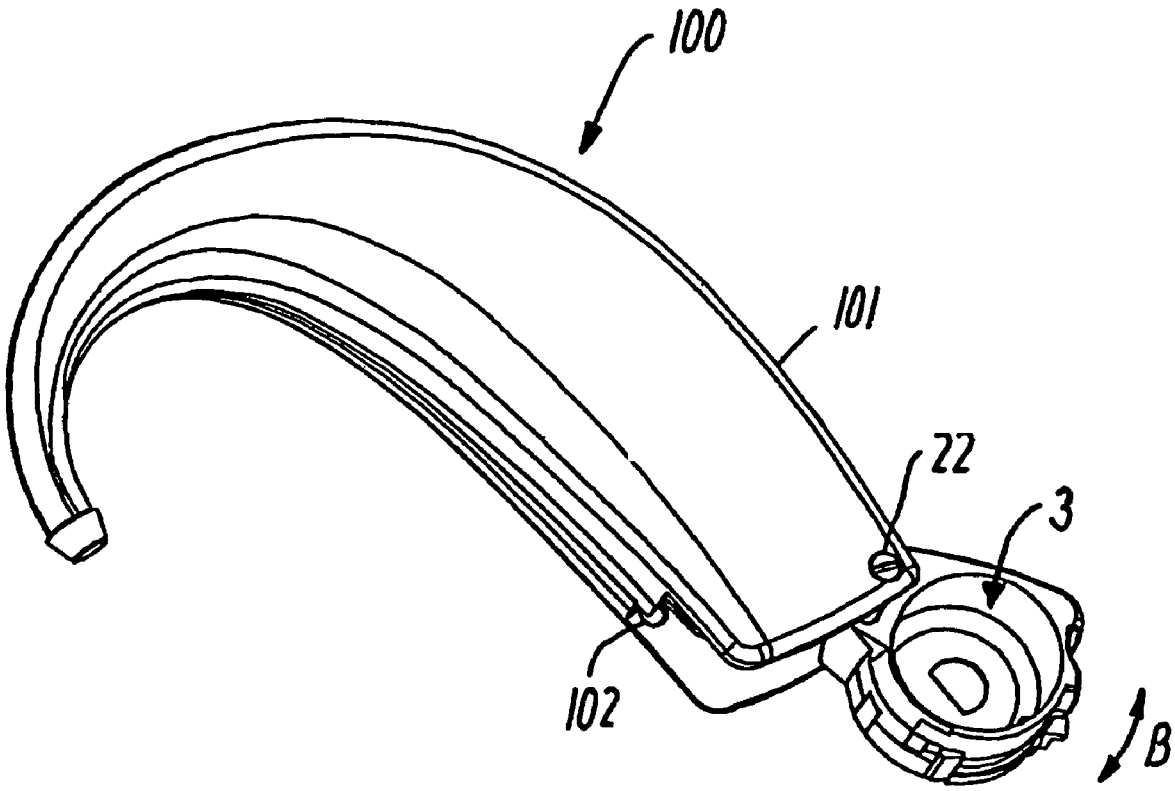
FIG. 10 shows the hearing aid of FIG. 8 with the battery compartment in an open position for the insertion of a battery.

The shaft or protrusions arranged in the hearing aid housing 101 also serve dual functions. When the retaining element 7 has been disengaged from the corresponding recess, which is preferably a cylindrical bore or indentation 102 in the interior wall of the hearing aid housing 101, the battery compartment may pivot in the X-Y plane about the shaft mentioned above, so as to open the battery compartment by sliding it out of the hearing aid housing 101, i.e. from the position illustrated in FIG. 8 to the position illustrated in FIG. 10. This other pivotal motion is illustrated by a second double arrow B, shown in FIG. 2 and FIG. 10.

It should be noted that upon removal of the screw 22, the battery compartment is fully removable from the hearing aid housing 101.

As mentioned above it is under certain circumstances necessary to restrict the access to the battery compartment, i.e. to prevent the battery compartment to be opened by e.g. children. Therefore, in the embodiment shown in FIGS. 1 to 6 the generally frustoconical boss carries a rib 8 prolonging the top surface 9 of the boss and ending in a plane surface or wall 10 arranged at a right angle to the top surface 9. This rib breaks the otherwise smooth conical surface of the frusto-conical boss. When the battery compartment is being closed, the conical surface acts as an inclined cam surface and lifts the resilient arm 6 up over the interior surface of the hearing aid housing 101, in the direction corresponding to upward in FIG. 2. When the retaining element 7 reaches the cylindrical bore or indentation 102 preferably constituting the corresponding recess, the arm 6 snaps back and the retaining element 7 locates itself in the cylindrical bore or indentation 102. This upward and downward motion is illustrated with the double arrow C in FIG. 2. A return motion of the battery compartment to the open position is prevented by the rib 8, which does not constitute an inclined cam surface. Rather, the wall 10 will abut the wall of the cylindrical bore and be blocked from further motion. The battery compartment may thus not immediately be moved back to the open position, and the battery is safely contained by the recess 3 in cooperation with a part of the hearing aid housing 101. As mentioned above, the battery compartment may pivot about the boss into a position, where the hearing aid is switched off. In this position, the battery is still safely contained by the recess 3 in cooperation with a part of the hearing aid housing 101.

In order to move the battery compartment back to the open position it is first necessary to release the latch. This is done by means of gripping or other digital manipulation of a gripping portion 21 arranged at the end of the arm 6. The arm 6 is then lifted in the direction corresponding to upward, as illustrated with the double arrow C in FIG. 2, out of the X-Y plane indicated in FIG. 2. This brings the wall 10 out of the cylindrical bore to a position above the internal surface of the hearing aid housing 101. The battery compartment may then be opened by pivoting about a shaft, such as the shaft of the screw 22, into a position where the battery can be removed. This dual motion of lifting the arm 6 before pivoting the battery compartment out of the hearing aid housing 101 provides for child-proofing.

Figure 7:
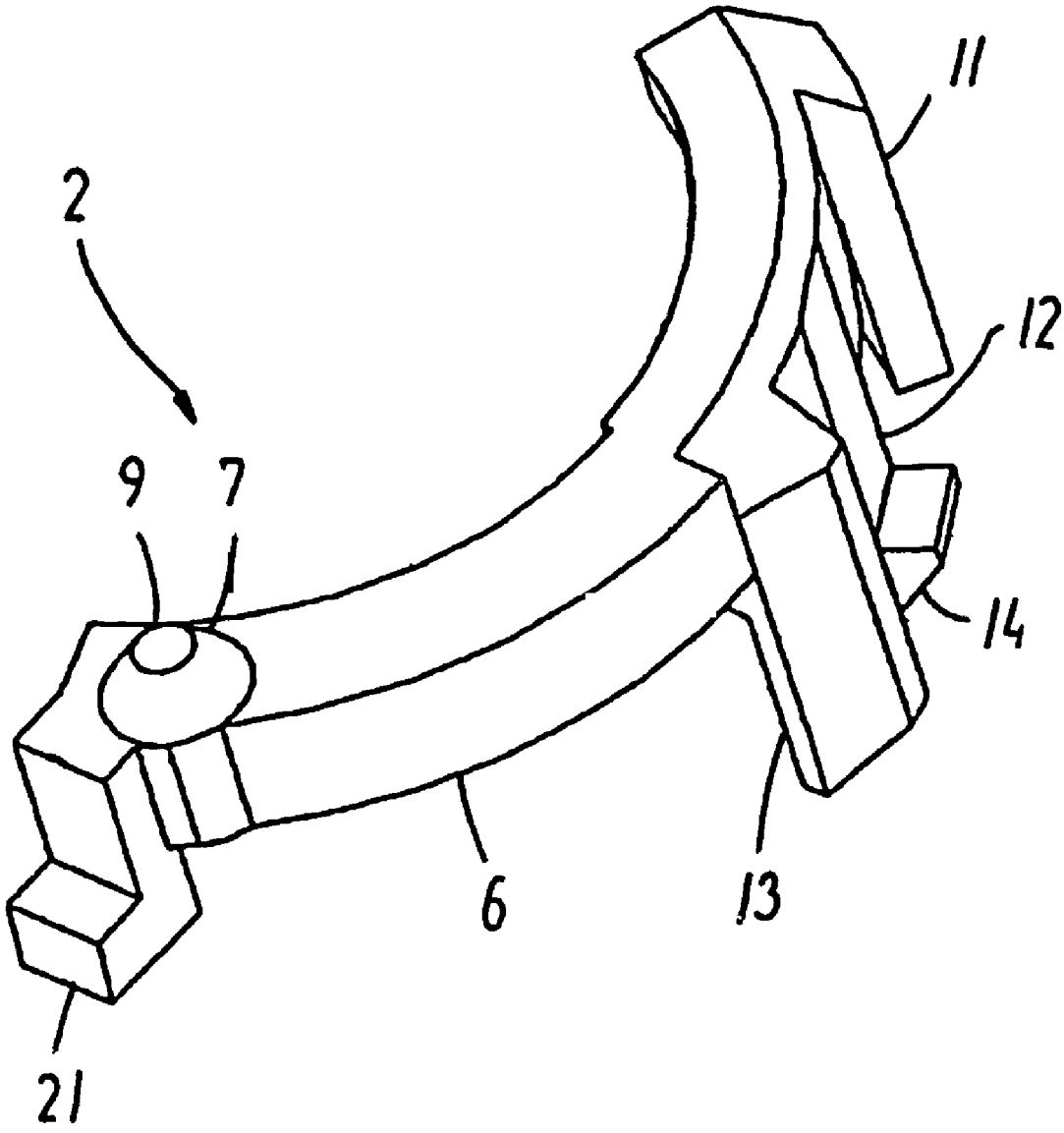
FIG. 7 shows a perspective view of a second embodiment of the second part of FIG. 1.

If no child-proofing is necessary, the second part 2 in the embodiment illustrated in FIGS. 1-6 may be replaced with the different embodiment of the second part 2 illustrated in FIG. 7. This embodiment of the second part 2 differs in principle only from that of FIGS. 1-6 in that the retaining element 7 does not carry a rib. The retaining element 7 is thus a frusto-conical member where the conical surface extends uninterrupted all the way around the circumference.

The conical surface may therefore act as a cam in either direction. Thus, when the battery compartment is being closed, the conical surface acts as an inclined cam surface in the same manner as in the previously described embodiments of FIG. 1-6, and lifts the resilient arm 6 up over the interior surface of the hearing aid housing, in the direction corresponding to upward in FIG. 2. When the retaining element reaches 7 the cylindrical bore or indentation 102 preferably constituting the corresponding recess, the arm 6 snaps back and the retaining element 7 locates itself in the cylindrical bore or indentation 102. However, it does not latch in the indentation, because the conical surface will, when the battery compartment is moved in the other direction towards the open position illustrated in FIG. 10, act as a cam and press the resilient arm 6 out of the indentation. Since however, a certain force is needed to bend the resilient arm 6 back out of engagement with the indentation, the battery compartment is secured in the closed position, if no external force is applied.

The different embodiments of the second part 2 are freely and readily interchangeable. As it has already been described above the barb 14 may be pressed back out of the aperture 18, so as to release the engagement, upon which the second part may be slid out of engagement with the first part 1, if it is desired to remove the second part 2. After removal of e.g. a latching second part 2 from the first part 1, it may be substituted with another, e.g. one which does not latch, but only retains the battery compartment in the hearing aid housing 101 due to the resilience of the arm 6 carrying the retaining element 7.

It should be noted that the above is only a preferred embodiment, and that the skilled person will recognize other ways to provide the retaining element. Thus, the retaining element 7 and the resilient arm 6 could be of different constructions, e.g. the retaining element 7 could be mounted in a resilient way on an otherwise rigid arm. Also, the resilient arm 6 could in principle be located elsewhere.

Instead of substituting the second part 2 for one of different construction it could also be substituted for one of generally similar construction. In particular, it could be substituted for one differing only by its color or markings thereon.

This allows hearings aids to optionally be provided with easily identifiable color codings. Thus, if it is desired to easily distinguish between the hearing aids for the left and the right ear, which have generally identical housings, the hearing aid for the right ear could be fitted with a red second part 2, whereas the one for the left ear could be fitted with a blue second part 2. The color combination would be freely selectable by the user, according to any preferred color-coding scheme. E.g. some people might prefer colors, which have the same initial letters as left or right in their language, e.g. "Red/Right" in English or "Rot/Rechts" in German. Others, on the other hand, might prefer a nautical combination having green right and red left. For people needing only one hearing aid or wishing less conspicuous hearing aids, a second part in a more discrete color matching the remainder of the hearing aid, e.g. beige.

Preferably the second part 2 is simply molded in one piece from a plastic material of the desired color, but evidently the second part 2 may instead be provided with color markings or partially colored by means of inlays. Other markings such as letters, be they indented, protruding or in colored print, could also be used.

Providing the battery compartment in two parts thus has the further advantage of providing easy individually selectable markings for hearing aids, because the second part 2 may be used for such.

Though described in the form of preferred embodiments the skilled person will appreciate that the invention is not limited to those. In particular, the actual shapes of the first and second parts, the way they interlock, and whatever the markings on them will be within reach for the skilled person to select.

I claim:

1. A battery compartment for a hearing aid, said battery compartment comprising a first portion for accommodating a battery and a second portion comprising a resilient arm having a retaining element, said arm including a latching element adapted for snapping into engagement with a housing of the hearing aid for selectively securing the position of said battery compartment with respect to the housing, said arm being movable according to a first motion between a first position wherein said latching element engages the housing, and a second position, wherein said first portion may be moved according to a second motion so as to open said battery compartment, said first and second portions of the battery compartment being provided as first and second separate parts, and said first and second parts comprising releasable interlocking means for mutual engagement.

2. The battery compartment according to claim 1, wherein said interlocking means comprises a barb.

3. The battery compartment according to claim 2, wherein said barb is located on said second part.

4. The battery compartment according to claim 1, wherein said latching element comprises a rib with a step provided on a protrusion of said arm.

5. The battery compartment according to claim 4, wherein said protrusion provides a pivot point for said battery compartment.

6. The battery compartment according to claim 1, wherein said second motion extends along a plane with respect to the housing, and wherein said retaining element is movable out of said plane.

7. The battery compartment according to claim 6, comprising means for permitting manually moving said retaining element out of said plane.

8. The battery compartment according to claim 1, comprising a code marking indicating which ear the hearing aid is intended for.

9. A hearing aid comprising a housing, and a battery compartment for accommodating a battery, said battery compartment having a first portion and a second portion, wherein said first and second portion are provided as first and second separate parts, said first and second parts having releasable interlocking means for mutual engagement, said second part comprising a resilient arm with a retaining element having a latching element adapted for snapping into engagement with said housing for selectively securing the position of said battery compartment with respect to said housing, said arm being movable according to a first motion between a first position wherein said latching element engages the housing, and a second position, wherein said battery compartment may be moved according to a second motion so as to open said battery compartment.

10. The hearing aid according to claim 9, wherein said latching element comprises a rib with a step provided on a protrusion of said arm.

11. The hearing aid according to claim 10, wherein said protrusion provides a pivot point for the battery compartment.

12. The hearing aid according to claim 9, comprising limiter means to delimit a pivoting motion of said battery compartment about said pivot point.

13. The hearing aid according to claim 9, wherein said second motion extends along a plane with respect to said housing, and wherein said first motion extends out of said plane.

14. A battery compartment for a hearing aid, comprising a resilient arm with a retaining element including a latching element adapted for snapping into engagement with a housing of the hearing aid for selectively securing the position of said battery compartment with respect to the housing, said latching element comprising a rib with a step provided on a protrusion of said arm, and said protrusion providing a pivot point for said battery compartment, said arm being movable according to a first motion between a first position wherein said latching element engages the housing, and a second position, wherein said battery compartment may be moved according to a second motion so as to open said battery compartment.

15. The battery compartment according to claim 14, wherein said second motion extends along a plane with respect to the housing, and wherein said retaining element is movable out of said plane.

16. The battery compartment according to claim 15, comprising means for permitting manually moving said retaining element out of said plane.

17. The battery compartment according to claim 14, comprising a code marking indicating which ear the hearing aid is intended for.

18. A hearing aid comprising a housing, a battery compartment for accommodating a battery, and a resilient arm connected with said battery compartment and provided with a latching element adapted for snapping into engagement with said housing for selectively securing the position of said battery compartment with respect to said housing, said latching element comprising a rib with a step provided on a protrusion of said arm and said protrusion providing a pivot point for the battery compartment, said arm being movable according to a first motion between a first position wherein said latching element engages the housing, and a second position, wherein said battery compartment may be moved according to a second motion so as to open said battery compartment.

19. The hearing aid according to claim 18, comprising:

limiter means to delimit a pivoting motion of said battery compartment about said pivot point.

20. The hearing aid according to claim 18, wherein said second motion extends along a plane with respect to said housing, and wherein said first motion extends out of said plane.

* * * * *

UNITED STATES PATENT AND TRADEMARK OFFICE

CERTIFICATE OF CORRECTION

PATENT NO. : 7,668,326 B2
APPLICATION NO. : 11/202089
DATED : February 23, 2010
INVENTOR(S) : Morten Linkenkær-Hansen It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1230 days.

Signed and Sealed this

Seventh Day of December, 2010

David J. Kappos

David J. Kappos
*Director of the United States Patent and Trademark Office*